United States Patent [19]

Komatsu

[11] Patent Number: 4,473,931

[45] Date of Patent: Oct. 2, 1984

[54] METHOD OF PRODUCING A TURBINE CASING

[75] Inventor: Hiroshi Komatsu, Yokosuka, Japan

[73] Assignee: Nissan Motor Co., Ltd., Yokohama, Japan

[21] Appl. No.: 469,272

[22] Filed: Feb. 24, 1983

[30] Foreign Application Priority Data

Mar. 24, 1982 [JP] Japan ..... 57-45553

[51] Int. Cl.[3] ..... B21K 3/04; B23P 15/02; B23P 15/04

[52] U.S. Cl. ..... 29/156.8 R; 29/527.6; 415/205; 415/208; 415/217; 415/219 C

[58] Field of Search ..... 29/156.8 R, 156.4 R, 29/156.8 CF, 156.4 WL, 156.8 FC, 527.6; 415/205, 208, 217, 219 C

[56] References Cited

U.S. PATENT DOCUMENTS

| | | | |
|---|---|---|---|
| 2,280,585 | 4/1942 | Kapitza | 415/205 |
| 2,944,786 | 7/1960 | Angell et al. | 415/205 X |
| 4,177,005 | 12/1979 | Bozung et al. | 415/205 X |
| 4,181,466 | 1/1980 | Owen | 415/219 C X |

FOREIGN PATENT DOCUMENTS

| | | | |
|---|---|---|---|
| 566942 | 8/1977 | U.S.S.R. | 415/205 |

*Primary Examiner*—Mark Rosenbaum
*Assistant Examiner*—Ronald S. Wallace
*Attorney, Agent, or Firm*—Schwartz, Jeffery, Schwaab, Mack, Blumenthal & Koch

[57] ABSTRACT

Simple machining of the inner surface of a tongue which has been deliberately formed so as to be thicker than required, allows for a ready reduction in the capacity of the turbine without resort to movable members.

1 Claim, 4 Drawing Figures

METHOD OF PRODUCING A TURBINE CASING

BACKGROUND OF THE INVENTION

1. Field of the Invention

The present invention relates generally to a method of producing a turbine casing or housing and more specifically to a method of producing a turbine casing via which the capacity thereof may be reduced by simple machining.

2. Description of the Prior Art

In a previously proposed method of producing a tubine casing the scroll housing 1 thereof has been initially formed with a tongue portion 2 longer than actually required and subsequently the length thereof machined down to a desired size. However, this method has suffered from the drawback that the capacity of the turbine can only be increased by this machining process. Thus, in the case that the casting of the turbine housing is such as to produce an arrangement which has a capacity greater than that required, correction of same has been extremely difficult.

For a detailed explanation of the above mentioned arrangement reference should be made to Japanese Patent Application Pre-Publication No. Sho 54-53705.

SUMMARY OF THE INVENTION

It is an object of the present invention to provide a method of producing a turbine casing or housing which permits the capacity thereof to be reduced via simple machining and without the need for movable parts to be provided within the housing per se.

The present invention takes the form of a method of producing a turbine having a scroll housing in which a tongue portion is defined and in which a turbine (having an axis of rotation) is disposed downstream of said tongue portion, which method permits the capacity of the turbine to be varied via the steps of (a) forming the tongue portion so as to have an outer surface arranged in a predetermined manner with respect to the axis of rotation and an inner surface located between the outer surface and the axis of rotation, the inner surface being arranged with respect to the outer surface so that the tongue has a predetermined thickness, and (b) machining the inner surface in a manner to reduce the thickness of the tongue to a thickness selected with respect to the required capacity of the turbine.

Thus, it will be appreciated that by ingeniously forming the tongue portion so as to be thicker than required, simple machining of the inner surface (viz., the surface closest to the axis of rotation of the turbine) permits the capacity of the turbine to be simply and accurately reduced to a desired level.

BRIEF SUMMARY OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
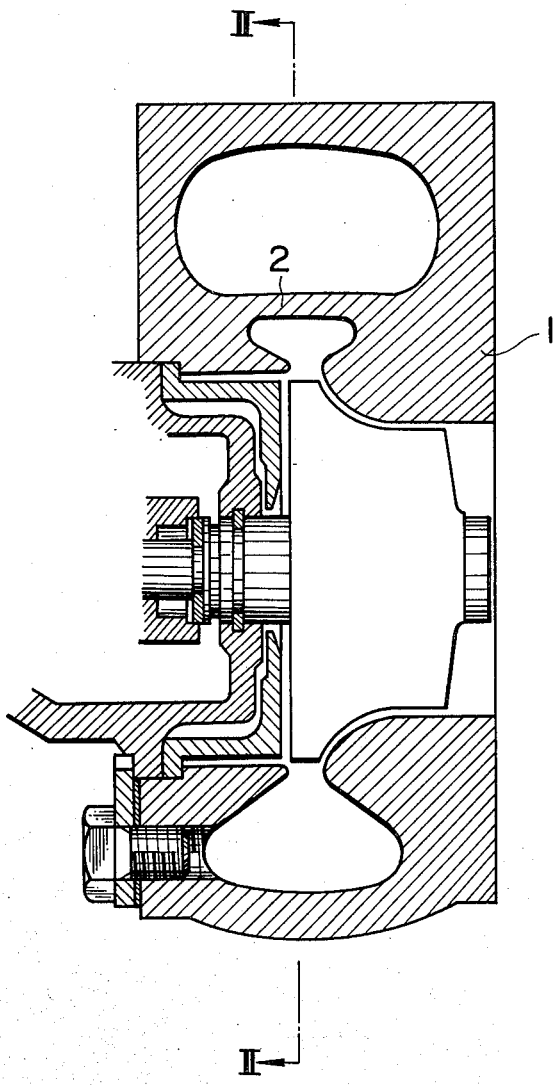
FIG. 1 is a sectional view of a prior art arrangement discussed briefly in the opening paragraphs of the present application.
Figure 2:
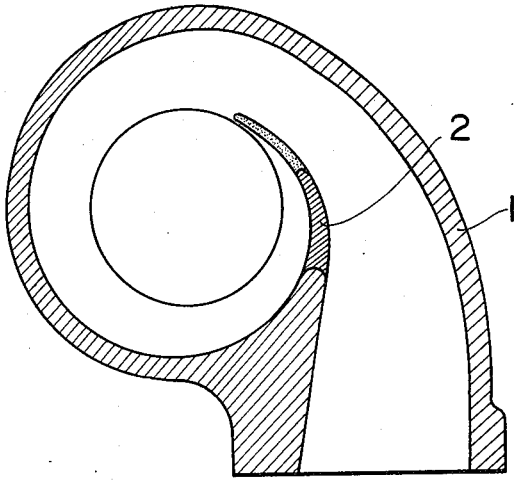
FIG. 2 is a sectional view as taken along section line II—II of FIG. 1.
Figure 3:
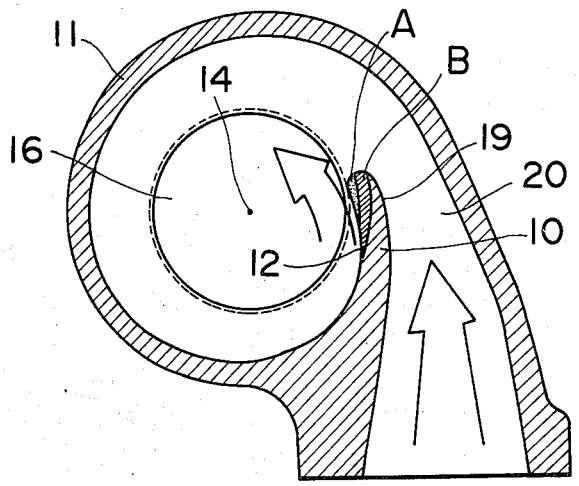
FIG. 3 is a sectional view similar to that of FIG. 1 but which shows a first embodiment of the present invention.

An embodiment of the present invention is shown in FIG. 3 of the drawings. As shown, according to the present invention, the tongue portion 10 of the scroll housing 11 is cast or otherwise formed to be relatively thick and in fact thicker than required. Subsequent machining of the inner surface 12 of the tongue (viz., the surface of the tongue closest to the axis of rotation 14 of the turbine) by inserting a suitable tool or device in through an aperture provided for the turbine wheel 16, the capacity of the arrangement may be selectively reduced by machining off part or all of sections A or B. Viz., by reducing the thickness of the tongue 10 in this manner, the amount of fluid deflected thereby during operation of the turbine is reduced and the amount of fluid having a velocity distribution similar to a free vortex which is allowed to continuously swirl within the scroll housing 11 and not be deflected toward and against the turbine wheel, is increased.

As will be appreciated the more of the tongue that is machined off, the lower the throttling effect provided thereby and the greater the amount of fluid which remains undeflected. This of course induces a reduction in turbine capacity.

As the outer surface of the 19 of the tongue remains unchanged by the above mentioned machining, the effect thereof on the incoming flow of fluid remains unchanged and the total amount of fluid flowing through the scroll housing maintained essentially constant. Fine control of the turbine may be achieved via slightly machining the outer surface 19 if required.

In the case that it is desired to be able to both increase as well as decrease the capacity of the turbine, all that is necessary it that the tongue 10 be formed so that the cross sectional area of the upstream portion 20 of the scroll housing 11 is reduced and appropriately machining the end of the tongue as in the case of the prior art. Of course suitable machining of the inner surface 12 as well as suitable finishing operations of the surface 19 may be suitably carried out in order to achieve the desired capacity.

Figure 4:
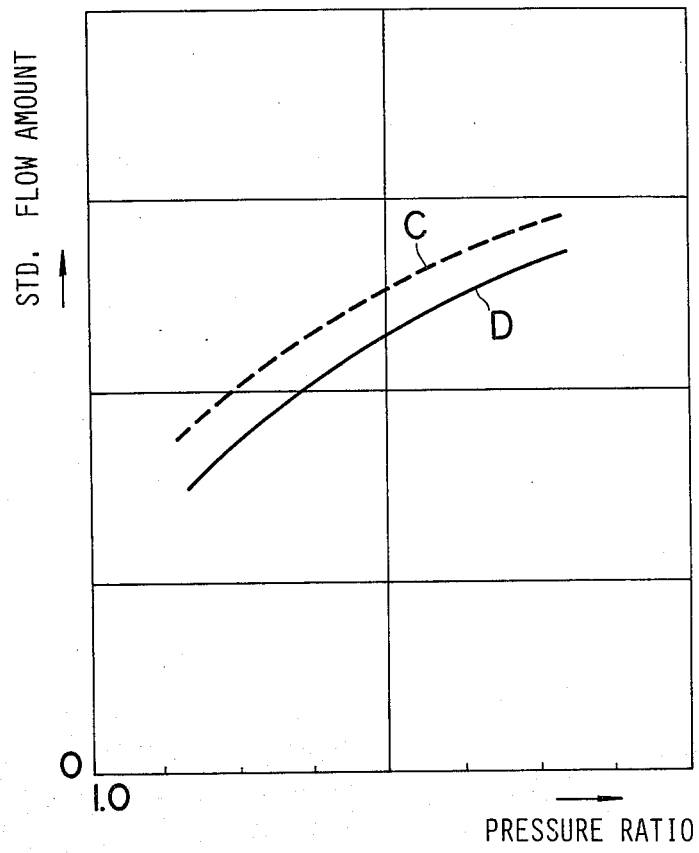
FIG. 4 is a graph showing, in terms of standardized flow amount and pressure ratio, the change in capacity of the turbine which may be obtained via the present invention.

FIG. 4 shows in graphic form the capacity reduction possible with the present invention. In this figure the broken line trace "C" represents the capacity of the arrangement with the tongue unmachined, while the solid line trace "D" indicates the capacity subsequent to machining of the inner surface 12. As will be noted the capacity of the arrangement is reduced with the thus induced thinning of the tongue.

What is claimed is:

1. A method of varying the capacity of a turbine having a scroll housing in which a tongue portion is defined and in which a turbine having an axis of rotation is disposed in said scroll housing downstream of said tongue portion, comprising the steps of:

forming said tongue portion so as to have an outer surface arranged in a predetermined manner with respect to said axis of rotation and an inner surface located between said outer surface and said axis of rotation, said inner surface being arranged with respect to said outer surface so that said tongue has a predetermined thickness; and machining said inner surface in a manner to reduce the thickness of said tongue to a thickness selected with respect to the required capacity of said turbine.

* * * * *